United States Patent [19]

Gelhard

[11] 4,393,672

[45] Jul. 19, 1983

[54] CYLINDER LOCK AND KEY ASSEMBLY

[76] Inventor: Egon Gelhard, Thomas-Mann-Strasse 10, D-5000 Köln 51, Fed. Rep. of Germany

[21] Appl. No.: 204,401

[22] PCT Filed: Dec. 13, 1979

[86] PCT No.: PCT/DE79/00144

§ 371 Date: Aug. 13, 1980

§ 102(e) Date: Aug. 13, 1980

[87] PCT Pub. No.: WO80/01299

PCT Pub. Date: Jun. 26, 1980

[30] Foreign Application Priority Data

Dec. 13, 1978 [DE] Fed. Rep. of Germany ..... 2853655

[51] Int. Cl.[3] ..... E05B 47/00

[52] U.S. Cl. ..... 70/277; 70/DIG. 46

[58] Field of Search ..... 70/279, 277, DIG. 46

[56] References Cited

U.S. PATENT DOCUMENTS

| | | | |
|---|---|---|---|
| 2,024,497 | 12/1935 | Alberti | 70/183 X |
| 2,105,304 | 1/1938 | Wagner | 70/277 |
| 3,347,072 | 10/1967 | Rose | 70/277 |
| 3,599,454 | 8/1971 | Hill et al. | 70/277 |
| 3,660,624 | 5/1972 | Bell | 70/DIG. 46 X |
| 3,733,862 | 5/1973 | Killmeyer | 70/277 |

*Primary Examiner*—William E. Lyddane

*Attorney, Agent, or Firm*—Allison C. Collard; Thomas M. Galgano

[57] ABSTRACT

A cylinder lock and key assembly for effecting a mechanical and/or electromechanical locking with recodable tumbler devices and devices which influence or generate electrical currents is provided. The assembly includes a key, a cylinder housing, a lock cylinder and a keyway disposed in the flat rib of the lock cylinder housing which receives the rotatable cylinder. The key and the keyway are provided with cooperating, exchangeable and codeable mechanical devices, e.g., pins, for a mechanical locking and devices which generate or influence electrical currents, e.g., resistors, inductors, capacities or semiconductors, for effecting an electromechanical arresting or other signal triggering.

12 Claims, 5 Drawing Figures

CYLINDER LOCK AND KEY ASSEMBLY

The invention relates to a cylinder lock and key assembly for a mechanical and/or electromechanical locking having a codable locking device and means for influencing or generating electric currents.

A plurality of types of locking and switching systems are known which as a basic principle use a cylinder lock, in particular, a profile-cylinder lock. Thereby, the devices which are mounted in the cylinder lock are brought into the release position by a purely mechanical operation by means of the key bit or by the crest profile of the inserted key, or in that permanent magnets are provided on the key which correspond with permanent magnets on the devices, thus triggering the opening or locking procedure. Furthermore, devices are known, wherein contacts for a current flow or a signal transmission may be closed or opened by the bit or crest, whereby the additional profile of the key represents an improvement on the variation possibilities.

Furthermore, a locking means is known which may be actuated by means of electric switch parts, consisting of a magazine housing for receiving the switch parts, preferably reed switches which are influenced by permanent magnets provided on the key which is inserted into the magazine, thus actuating the prescribed code for actuating the locking means. Thereby, in the known device the possibility exists that the reed switch for opening or closing, as well as the permanent magnets on the key are exchangeable. In this manner the key code may be adjusted by the user himself without using special tools and without the knowledge of the code by third parties.

In the locking and switch systems which operate in accordance with current locking methods or which control the signal transmission for the electronic structure elements, a changing of the code is made impossible by third parties without the permission of the user or the use of specific tools and experts. Since the standardized dimensions for profile locking barrels contain about five or a maximum of seven devices on the key profile, it is obvious that this is not sufficient for safety devices. In the known devices, the key conduit is based on purely mechanical, electrical or electronic basis on the rotatable barrel core, and it is relatively easy to get to the locking element or the locking element coupling by boring open the key conduit immediately at the locking element coupling, so as to open the devices which are rendered immovable by the locking procedure, thus opening the container protecting the valuables.

As far as is known in single key devices the same highly developed system is used for saving the valuables, i.e., the system is used which assures the high degree of safety for a specific application, although it would not be required in other cases. Therefore, intermediary and connecting doors which are equipped with a building locking and alarm device must be equipped with the same highly developed system which renders the device very expensive. In the locking devices which are actuated by means of permanent magnets relatively voluminous and complicated housings for receiving the individual parts are required which cannot be used in normal cylinder locks without requiring an expensive reconstruction.

It is therefore an object of the invention to provide a cylinder lock with a key for a mechanical, electromechanical or electronic actuating device which can be placed into the structured installation space of a commonly known profile cylinder locking device which can be coded in a plurality of ways by the user having a high degree of safety against boring open the device, and which can be made at a reasonable price.

This object of the invention is obtained according to the invention in that a cylinder lock with a key is provided for mechanical and/or electromechanical locking having a codable locking device and means for influencing or generating electric currents. This lock has a conduit for introducing the key in the plane cross-bar of the casing of the cylinder lock which contains the lock cylinder, the key and the conduit are provided with interchangeably devices cooperating between each other interchangeably, capable of being coded mechanically, these devices being capable of influencing or generating electric currents for a mechanical and/or electromechanical locking, or for the releasing of any signal.

Therefore, the key conduit keyway in the inventive device is not mounted around the rotatable core of the cylinder, but is mounted in the fixed flat cross-bar below the cylinder housing (casing), so that the total space of the rotatable cylinder is free to receive up to a maximum of ten mechanical locking devices.

The rotating cylinder may be provided with a rotating knob or handle at the front face thereof, so that the forces which are necessary to introduce the locking displacement are made easier, in contrast to an inserted key which is usually attached to a key ring together with a lot of other keys. Since the rotating cylinder does not have an open key conduit which is easily accessible from the outside, but is provided at its front face with a massive handle or rotating button, for example, made of hard metal, it is impossible to bore open such a cylinder lock.

Furthermore, the inventive cylinder lock has the advantage that the key itself has at its crest exchangeable teeth for actuating longitudinally adjusted pins which are received by the crest, and that the key has to be inserted into the cylinder lock, instead of being subjected to a rotating moment. Furthermore, a maximum of up to six exchangeable electrical current influencing or generating devices may be provided in the inside of the key for standard profile cylinders, for example, miniature block resistors with plug contacts, whereby these resistors serve systems which operate in accordance with the current contact method, as well as contacts for a circuit of pure electronic devices.

Naturally, instead of miniature resistors, any other suitable active and passive electrical structural elements may be used, for example, inductors, capacitors or semiconductors.

Due to the exchangeability of the cylinder lock with key in accordance with the invention in contrast to the generally known profile cylinder locks it is possible to actuate with only one key locking systems of different types on doors, windows, cabinets, containers, control clocks, etc. and switching systems for central locking alarm and registering devices of all kinds, whereby the different locking and switching devices may be coded in a different manner by the user without using special tools or special devices, whereby this change must be taken care of in the mechanical, electrical or electronic parts, either individually or commonly.

It should also be emphazised that when the inventive cylinder lock is transferred to a profile double cylinder lock, the couplings for the connection of the cylinder lock and the locking actuating is closed by an intermediary lever by inserting the key into the cross bar of the cylinder casing. For actuating circuits the total cylinder rotating construction group together with the coupling and the locking means may be eliminated, so that a key casing with smooth key conduit is required with embedded counter contacts therein.

The advantages of the inventive cylinder lock with key are as follows:

1. Only one key is required for different locking and circuit systems based on a pure mechanical and/or electrical and/or electronic basis.

2. One obtains a large variation number of up to ten variations with each four pair variations in conjunction with, 3. up to a maximum of six contact resistors for each twenty resistor groups, i.e. 3.6 trillion practically useable variations.

4. A change in the code by the authorized user is made possible in an easy manner, as well as an easy change of the teeth-pin-pairs, as well as the comparing resistors.

5. An easy servicing is provided by a simple inserting the key into a fixed key conduit and by providing the forces for the locking actuation by means of a rotating knob or handle.

6. This provides a high degree against breaking and tempering, since the key conduit is not provided in the cylinder.

The invention will now be explained in conjunction with the embodiments shown in the drawings.

Figure 1:
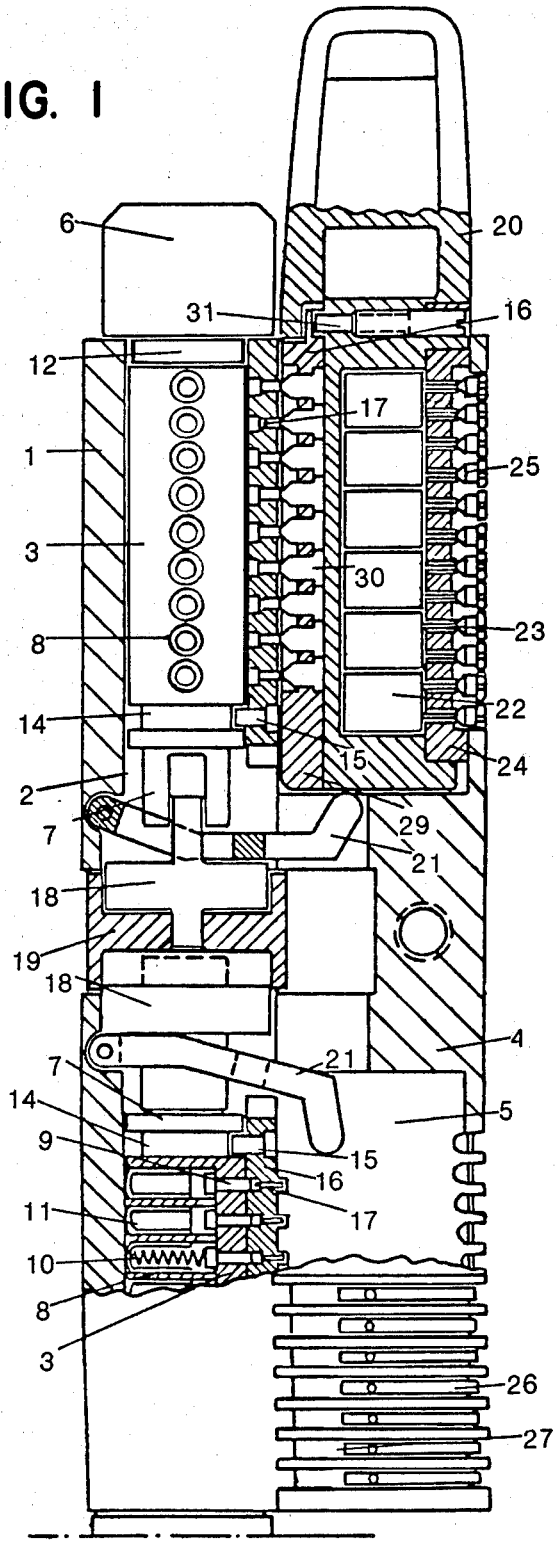
FIG. 1 is a partially schematic longitudinal sectional view through a profile-double cylinder lock with an inserted key.

As can be seen from FIG. 1, the two rotatable cylinders 3 are inserted in a smooth through bore 2 which runs in a longitudinal direction. In the cross-bar or crosspiece 4 of casing 1 of the cylinder housing one key conduit 1 is arranged at both sides, whereby the upper conduit is turned by about 90°. At the end of each of the cylinders 3 a knob or rotating handle 6 is provided, and at the inner end of each one a slot coupling 7 is provided. Each cylinder is provided with a plurality of transversely running bores 8 into which the core pins 9, the coil pressure springs 10 and their associated spring housings 11 are inserted. As an additional safety feature opening by boring a hardened steel pin 12 is provided. The axial positioning of the cylinder 3 is obtained by a transversely inserted retaining pin 13 (FIG. 2) which engages in a circumferential annular groove 14 (FIG. 1).

Furthermore, a guide pin 15 also extends into this annular groove 14, the pin is inserted in a bar 16 having a plurality of bores in which axially displaceable intermediary pins 17 are received. After unscrewing the retaining pin 13 (FIG. 2), cylinder 3 and the associated bar 16 may be removed together as a unit.

The slot couplings 7 of cylinders 3 are positively locked with the locking lug 19 by means of a coupling piece 18, when they are displaced by a inserted key 20 by means of a lever 21 in the direction of the locking lug 19 and engage the same. Thereby, only the rotatable cylinder 3 couples with locking lug 19, whereby a key 20 is completely inserted into the locking conduit or keyway 5. The key 20 itself, shown as a flat key in this embodiment receives the miniature resistors 22 which are inserted into the support bar 24 by means of contact pins 23 which extend somewhat from the support bar. The counter contacts 25 are mounted on contact springs 26 which are imbedded in an isolated manner in casing grooves 27.

The contact springs simultaneously act as conduct paths and permit a reliable current transmission.

A further receiving bar 29 is inserted on the upper crest 28 (FIG. 5) of key body 20 which receives a corresponding number of exchangeable teeth 30 which correspond to the number of intermediary pins 17, thus forming a tooth-pin-pair. The screw 31 assures the connection between the receiving bar 29 and key 20.

Figure 2:
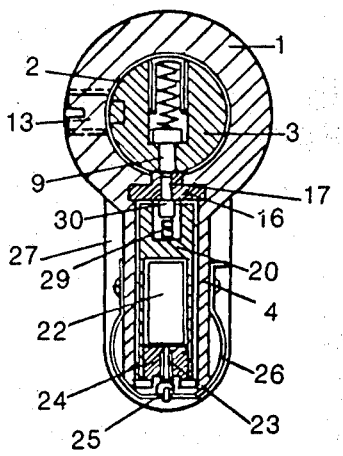
FIG. 2 is a partially schematic cross sectional view through a profile cylinder lock taken along a plane through the middle (center) of the rotatable cylinder and inserted key.

FIG. 2 shows a cross sectional view through the embodiment of FIG. 1, whereby the sectional plane runs through the rotatable cylinder 3 and the inserted key 20 and runs exactly through a tooth 30 and pin 17 pair. The length of the tooth 30 and the intermediary pin 17 is so defined that the core pin 9 which is displaced by the intermediary pin is coupled with the outer cross section (outer diameter) of the rotatable cylinder, thus releasing the rotatable cylinder. At the same time, the contact pins 23 with the spring mounted counter contacts 25 engage in the lower part of the key body 20, so that an electrical voltage is obtained in two of the contact springs 26 which are imbedded in an isolated manner in grooves 27, so that a current flows from the miniature resistor 22 which is used for the further control purposes on a mere electric or electronic basis.

By changing the miniature resistors 22 or by exchanging the same the variation width in the electrical part is obtained in the same manner as one would obtain a mechanical change by exchanging the tooth-pin pairs.

Figure 3:
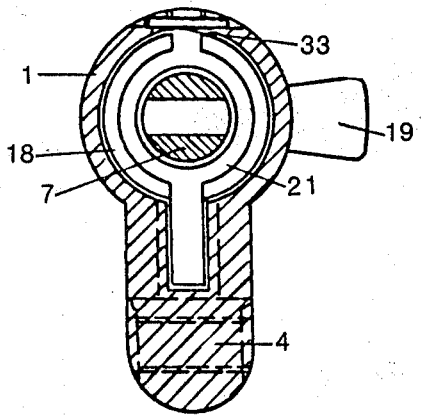
FIG. 3 is a partially schematic, sectional view through a profile double cylinder with sectional taken along a plane through the coupling portion with the locking actuator.

FIG. 3 also shows a cross sectional view of a possible embodiment of the invention in accordance with FIG. 1 having the sectional plane through the coupling portion. This view clearly shows that lever 21 is pivotable around pin 32. The lever 21 is displaced at its lower end by key 20, whereby the coupling piece 18 engages into the corresponding groove of the locking lug 19. The locking lug is shown in a pivoted position by about 90°.

Figure 4:
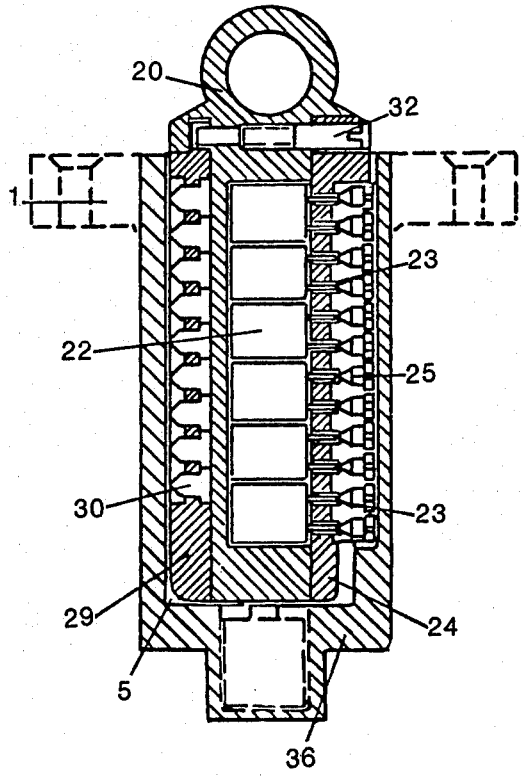
FIG. 4 is a partially schematic longitudinal view through a switching device with the key.

FIG. 4 shows a longitudinal view through a switching arrangement in a simplified view not according to scale and which is actuated by the key 20. Thereby, the switch housing 33 may be shaped in accordance with the desired use and may have only one key conduit 5 having cutouts in the base thereof, through which the spring biased counter contacts 26 come into engagement with contact pins 23 of the miniature resistors 22 when the key 20 is inserted. Thereby, the exchangeable teeth 30 in the receiving (supporting) bar 29 of key 20 have no function.

Figure 5:
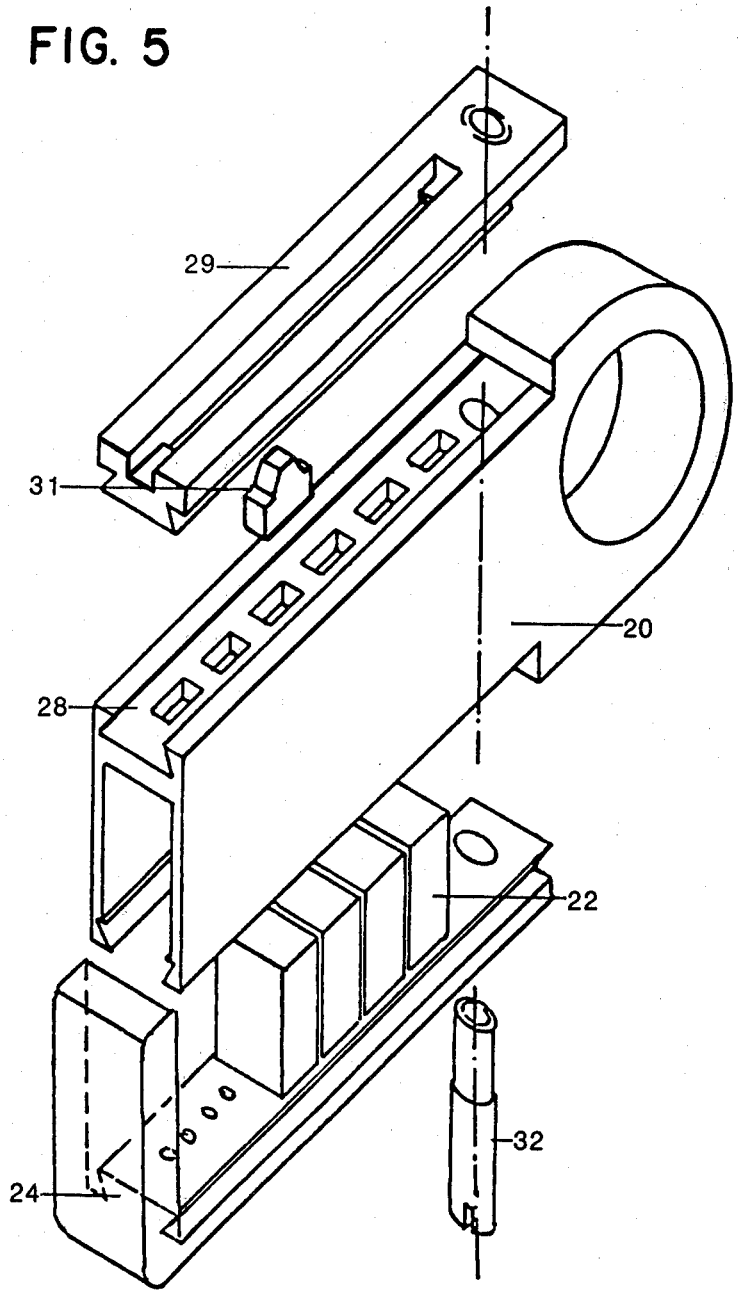
FIG. 5 is a partially schematic, exploded perspective view of an opened key.

FIG. 5 shows a taken apart key for the purpose of changing the code, whereby the view is a perspective one.

After removing the pin screw 31 from the key body 20, the support bar 24 with the inserted miniature resistors 22 may be removed from the key body 20, so that the positions of the miniature resistors 22 may be exchanged with respect to each other, or that the miniature resistors 22 may be replaced by other resistor values.

Also, bar 16 with intermediary pins 17 may be removed from the casing 1 of the cylinder lock, so that the positions of the intermediary pins may be exchanged or replaced by others having a different length. Care should be taken that, in such a case, teeth 30 in key 20 must also be exchanged in such a manner that the length of the teeth correspond with the length of the pins. It should also be emphazised that instead of resistors 22, other electrical or electronic components may be used. For example, semiconductors, integrated circuits, capacitors, inductors may be used which are provided with the corresponding contact pins and which are in contact with the electrical and/or the electronic components by means of connecting lines.

We claim:

1. A cylinder lock and key assembly for effecting a mechanical and electro-mechanical locking, comprising:

a lock cylinder casing having a cylinder-receiving bore and a crosspiece offset from said bore in which a keyway is formed, a lock cylinder rotatably mounted in said cylinder-receiving bore of said casing, and a key receivable in said keyway, said key and said keyway being provided with interchangeable and mechanically codable tumbler means for effecting a mechanical locking and electrical means for changing the flow of electric current for effecting an electromechanical locking signal.

2. The assembly of claim 1, wherein said lock cylinder is coupled to and actuates a locking lug and is provided with a rotatable knob at its outer end, said lock cylinder also being provided with a plurality of transverse bores into which core pins with associated springs are inserted, and said key being provided with interchangeable intermediary pins and teeth which cooperate with said core pins of said cylinder for permitting, in one position thereof, rotation of said cylinder.

3. The assembly of claim 2, wherein coupling means is mounted between said lock cylinder and said locking lug which includes a lever and which provides positive locking between said cylinder and said lug after the key has been inserted into said keyway.

4. The assembly of claim 2, wherein said key has an upper crest along one edge thereof and a receiving bar fixedly retained therein by means of a pin screw and wherein said teeth of said key which cooperate with said exchangeable intermediary pins are exchangeably and releaseably mounted in said receiving bar.

5. The assembly of claim 2, wherein said knob is at least partially made of hard metal.

6. The assembly of claim 2, wherein said exchangeable teeth, said intermediary pins, and said electrical means are correspondingly marked for defining a code.

7. The assembly of claim 1, wherein said cylinder is held in said cylinder-receiving bore in a fixed axial position by means of a retaining pin and wherein said intermediary pins are guided in said bar, the latter of which can be removed together with said lock cylinder from said bore of said casing of the cylinder lock after removing said retaining pin.

8. The assembly of claim 1, wherein said key has a hollow housing and a support bar fixed and retained by a screw pin in said housing, and wherein said electrical means comprises miniature resistors which are disposed in said hollow housing of said key and are exchangeably mounted on said support bar.

9. The assembly of claim 8, wherein said miniature resistors have contact pins which extend beyond said support bar and cooperate with spring biased counter contacts which are mounted in an isolated manner in grooves formed in said casing.

10. The assembly of claim 1, wherein said electrical means are selected from the group consisting of inductors, capacitors and semiconductors.

11. The assembly of claim 1, wherein a hardened steel pin is mounted in said key adjacent to said hollow housing as an additional safety against opening by boring.

12. The assembly of claim 1, wherein an electrical switch for triggering desired control signals is provided in said keyway, at the front end thereof.

* * * * *